United States Patent [19]

Meguro et al.

[11] 4,410,868

[45] Oct. 18, 1983

[54] DIELECTRIC FILTER

[75] Inventors: Takeshi Meguro; Yukio Ito, both of Kawasaki; Bun-ichi Miyamoto, Sagamihara, all of Japan

[73] Assignee: Fujitsu Limited, Kawasaki, Japan

[21] Appl. No.: 279,461

[22] Filed: Jul. 1, 1981

[30] Foreign Application Priority Data

Jul. 7, 1980 [JP] Japan ..... 55-92380

[51] Int. Cl.[3] ..... H01P 1/205; H01P 1/208; H01P 7/04; H01P 7/06

[52] U.S. Cl. ..... 333/202; 333/207; 333/209; 333/212; 333/223

[58] Field of Search ..... 333/219–235, 333/202–212, 245, 248

[56] References Cited

U.S. PATENT DOCUMENTS

| | | | |
|---|---|---|---|
| 3,505,618 | 4/1970 | McKee | 333/203 |
| 4,216,448 | 8/1980 | Kasuga et al. | 333/212 X |
| 4,291,288 | 9/1981 | Young et al. | 333/212 |

FOREIGN PATENT DOCUMENTS

| | | | |
|---|---|---|---|
| 1199908 | 7/1970 | United Kingdom | 333/231 |

OTHER PUBLICATIONS

Wakino et al.–"Quarter Wave Dielectric Transmission Line Diplexer for Land Mobile Communications", 1979 IEEE MTT-S International Microwave Symposium Digest, IEEE Catalog No. 79CH 1439-9 MTT; pp. 278–280.

Fukasawa et al.–"Miniaturized Dielectric Radio Frequency Filter for 850 MHz Band Mobile Radio", IEEE 26th TTC, Mar. 1979; pp. 181–186.

Kamashita et al.–"Compact Band Pass Filters for 800 MHz Band Land Mobile Equipments", Proceedings of the IEEE, vol. 67, No. 12, Dec. 1979, pp. 1666–1669.

*Primary Examiner*—Marvin L. Nussbaum
*Attorney, Agent, or Firm*—Staas & Halsey

[57] ABSTRACT

A dielectric filter in which a plurality of holes are made at predetermined intervals in a dielectric block of small dielectric loss, and a conductor film is formed on the surface of the dielectric block including the interior surfaces of the holes to constitute resonators using the conductor film on the interior surface of each hole as an inner conductor of the resonator and the conductive film on the outer peripheral surface of the dielectric block as an outer conductor, the resonance frequency of the resonators being based on the depth of each hole.

15 Claims, 19 Drawing Figures

DIELECTRIC FILTER

BACKGROUND OF THE INVENTION

1. Field of the Invention

The present invention relates to a dielectric filter which is stable mechanically and electrically.

2. Description of the Prior Art

In mobile radio communication systems such as land mobile radio communication systems and the like, the frequency used has been raised from the VHF band to the UHF band and then to the microwave band so as to meet the demand for a greater number of channels. Mobile radio communication systems call for small-sized, lightweight and economical radio equipment. To satisfy the requirements, it has been proposed to employ a dielectric filter as a filter or antenna duplexer for separating transmitting and receiving waves of vehicular radio equipment, for example, for a 800 MHz band land mobile radio communication system, so that an antenna may be used in common.

The aforesaid dielectric filter is a multi-section filter which is produced by metalizing required surfaces of cylindrical dielectric rods of different lengths to form coaxial and/or re-entrant resonators and arranging them in a metal case in predetermined positions. Assuming that the dielectric constant of the dielectric material used is 40, the size of the dielectric filter can be made about $1/\sqrt{40}$ that of an ordinary waveguide type filter (a coaxial and/or re-entrant filter which does not use the dielectric material).

Since vehicular radio equipment is exposed to severe environmental conditions as of vibration, shock, temperature, humidity and so forth, however, the dielectric filter is also required to stably operate under such conditions; accordingly, in the multi-section filter, the resonators must be housed in a rigid metal case. This is an obstacle to mass production of the dielectric filter and reduction of its size and weight.

SUMMARY OF THE INVENTION

Accordingly, it is a primary object of the present invention to provide a dielectric filter which is easy to manufacture, inexpensive, small-sized, lightweight and stable mechanically and electrically.

Briefly stated, according to the present invention, a plurality of holes are made in a dielectric block at predetermined intervals; a conductor film is formed over the surface of the dielectric block including the interior surface of each hole to constitute resonators, each having a resonance frequency decided by the depth of each hole; and air gaps are formed in the dielectric block for adjusting the coupling between adjacent ones of the resonators and the resonance frequency of each of them.

DESCRIPTION OF THE PREFERRED EMBODIMENTS

Figure 1A:
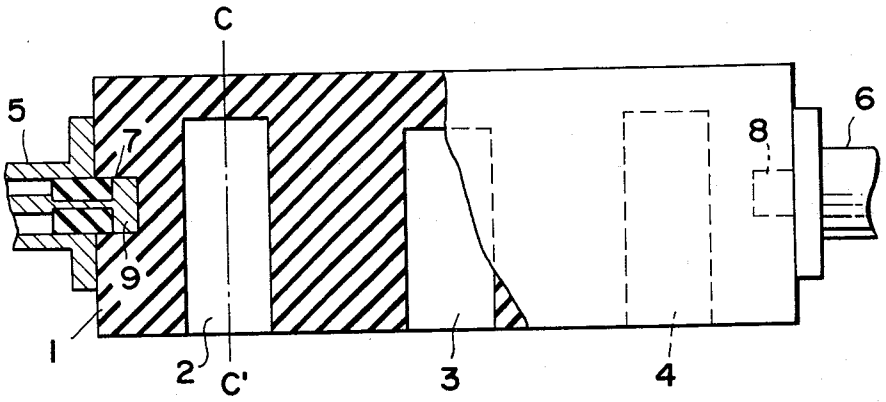
FIGS. 1A to 1C, 2A to 2C and 3A to 3C are partly-cut-away side views, bottom views and sectional views respectively showing different embodiments of the present invention.
Figure 1B:
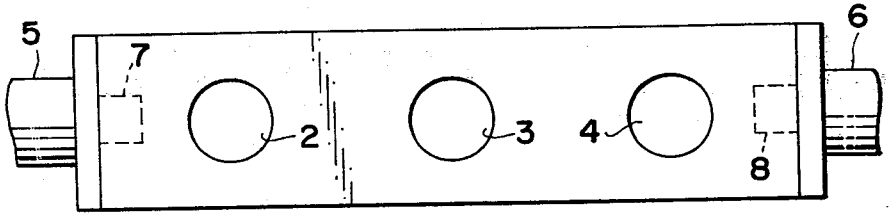
Figure 1C:
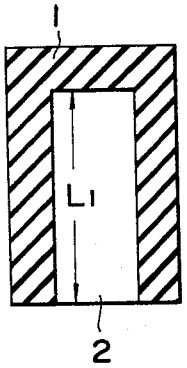

FIGS. 1A through 1C illustrate an embodiment of the present invention, FIG. 1A being a partly-cut-away side view, FIG. 1B a bottom view and FIG. 1C a sectional view taken on the line c-c' in FIG. 1A. This embodiment shows a quarter wave dielectric filter with three sections. As illustrated, holes 2, 3 and 4 are made in a block 1 of ceramics or a like dielectric material with small dielectric loss to extend from the underside thereof. The depth L1 of each hole is selected to be a quarter wave length ($\lambda/4$, $\lambda$ being the working wavelength). Further, holes 7 and 8 are made in the opposite sides of the dielectric block 1 for receiving connectors 5 and 6, respectively. The dielectric block 1 is metalized over the entire area of its surface except the holes 7 and 8. Reference numeral 9 indicates a disc for electrical coupling; and a similar disc is present at connector 6.

The interior surfaces of the holes 2, 3 and 4 are also entirely metalized to form inner conductors of resonators and the conductor film formed by the metalization on the outer peripheral surface of the dielectric block 1 serves as an outer conductor. Thus, quarter wave resonators are constituted and each resonator couples electromagnetically through the dielectric material of the dielectric block 1, providing a three-section filter between the connectors 5 and 6.

By metalizing the entire surface of the dielectric block 1, including the interior surfaces of the holes 2, 3 and 4 as described above, three resonators are constituted and their electrical shielding is also provided by the metalized layer. Further, the filter has a unitary structure though it is composed of the three resonators. Accordingly, the filter is easy to produce and resists vibration and shock well. Moreover, the formation of the metalized layer eliminates the necessity of housing the filter in a metal case. It is a matter of course that the metalization can be performed by known means.

Figure 2A:
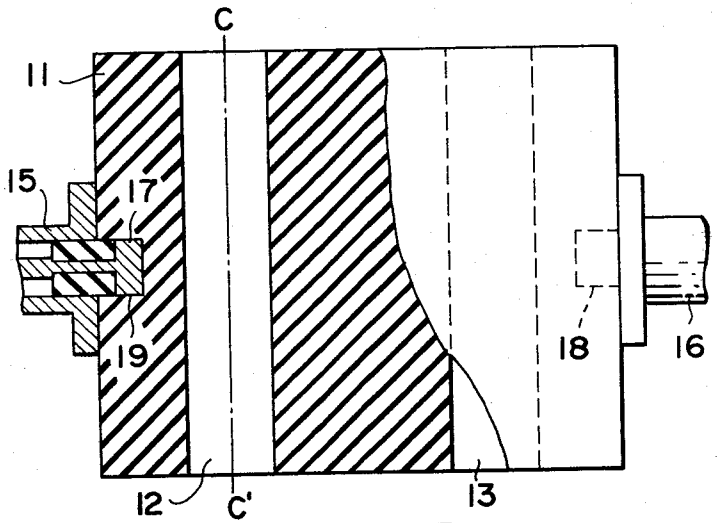
Figure 2B:
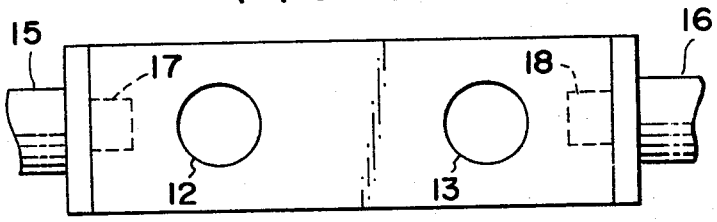
Figure 2C:
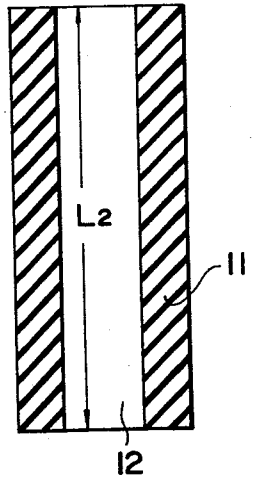

FIGS. 2A to 2C illustrate another embodiment of the present invention, FIG. 2A being a partly-cut-away side view, FIG. 2B a bottom view and FIG. 2C a sectional view taken on the line c-c' in FIG. 2A. This embodiment is directed to a half wave dielectric filter with two sections. As shown, through holes 12 and 13 are made in a dielectric block 11 and the depth L2 of each hole is selected to be half wave length ($\lambda/2$). Holes 17 and 18 for receiving connectors 15 and 16, respectively, are made in the opposite sides of the dielectric block 11 and the block 11 is metalized over the entire area of its surface except the holes 17 and 18. Consequently, by metalized layers on the interior surfaces of the holes 12 and 13, two half wave resonators are constituted to provide a two-section filter between the connectors 15 and 16. Reference numeral 19 indicates a disc for electrical coupling.

Figure 3A:
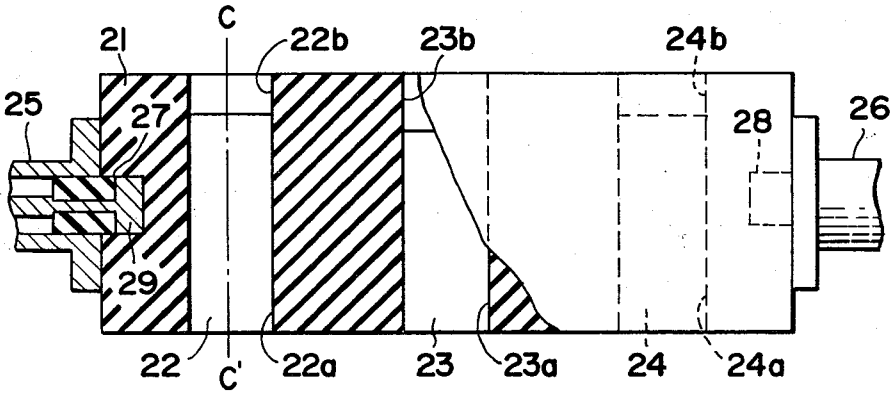
Figure 3B:
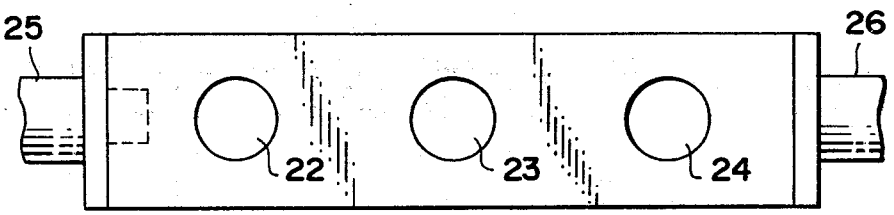
Figure 3C:
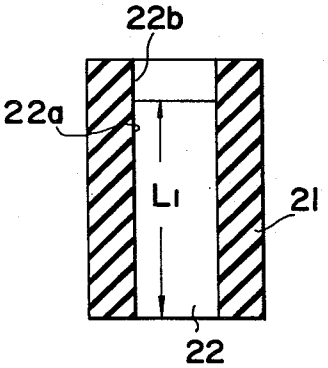

FIGS. 3A through 3C illustrate another embodiment of the present invention, FIG. 3A being a partly-cut-away side view, FIG. 3B a bottom view and FIG. 3C a sectional view taken on the line c-c' in FIG. 3A. This embodiment is directed to a quarter wave dielectric filter similar to that of the embodiment depicted in FIGS. 1A to 1C. In this embodiment, through holes 22, 23 and 24 are made in a dielectric block 21 and holes 27 and 28 for receiving connectors 25 and 26, respectively, are made in the opposite sides of the dielectric block 21. The dielectric block 21 is metalized over its surface except for the holes 27 and 28 and selected portions 22*b*, 23*b* and 24*b* of the interior surfaces of the holes 22, 23 and 24. In consequence, quarter wave resonators are formed by metalized layers deposited on the remaining portions 22*a*, 23*a* and 24*a* of the interior surfaces of the holes 22, 23 and 24. Reference numeral 29 designates a disc for electrical coupling.

The selected portions 22*b*, 23*b* and 24*b* of the interior surfaces of the holes 22, 23 and 24 are not metalized as described above but this does not bring about any disadvantages since energy mostly tends to be stored in the dielectric body when the dielectric block 1 has a large dielectric constant. This embodiment is advantageous in that the formation of the holes is easier than in the embodiment of FIG. 1. More complete shielding can be achieved by closing the upper and lower open ends of the holes 22, 23 and 24, for example, with conductor foils.

Figure 4A:
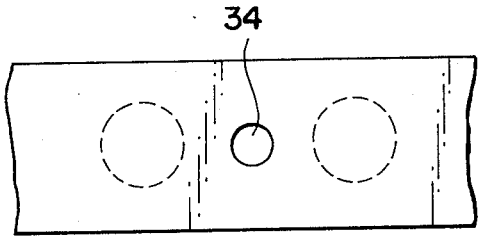
FIGS. 4A to 4D are respectively a top plan view, a partly-cut-away side view, a bottom view and a sectional view illustrating another embodiment of the present invention.
Figure 4B:
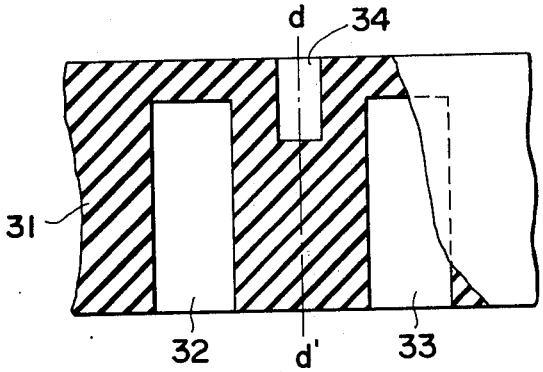
Figure 4D:
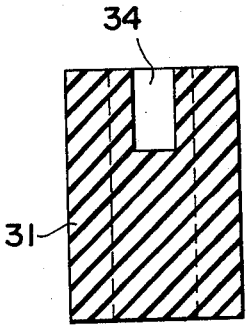
Figure 4C:
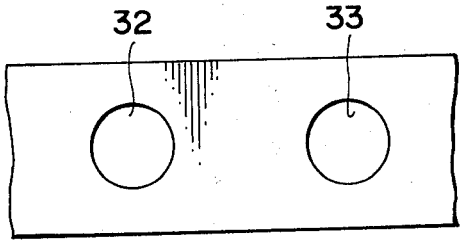

FIGS. 4A to 4D, inclusive, illustrates another embodiment of the present invention in which an air gap is provided between adjacent resonators, FIG. 4A being a top plan view, FIG. 4B a partly-cut-away side view, FIG. 4C a bottom view and FIG. 4D a sectional view taken on the line d-d' in FIG. 4B. Holes 32 and 33 are made in a dielectric block 31, which is metalized over its surface to form resonators by metalized layers deposited on the interior surfaces of the holes 32 and 33. A hole 34 is made in the dielectric block 31 between the resonators. Accordingly, the hole 34 provides an air gap between the resonators and the coupling between them and their resonance frequencies can be adjusted by varying the size and position of the hole 34. It is possible to adjust mainly the coupling between the resonators or mainly the resonance frequency of each resonator in the vicinity thereof; but, by providing such an air gas at an appropriate position, both the coupling and the resonance frequency can be adjusted. It is also possible to provide a plurality of air gaps for the respective purposes. The air gap between the resonators may be a slot.

Figure 5A:
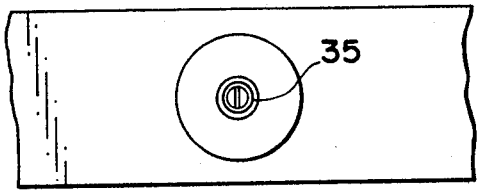
FIGS. 5A to 5C are respectively a top plan view, a partly-cut-away side view and an end view illustrating another embodiment of the present invention.
Figure 5B:
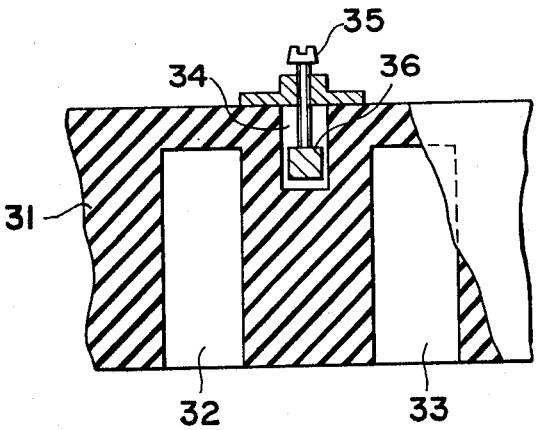
Figure 5C:
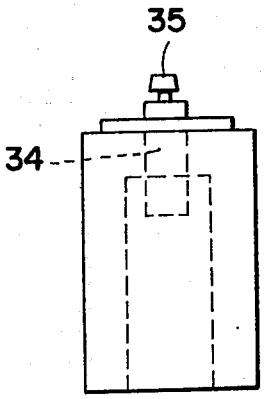

FIGS. 5A to 5C shows a modified form of the embodiment of FIG. 4, in which an adjusting member 36 is disposed in the hole 34 so that the coupling between the resonators may be varied as desired. FIG. 5A is a top plan view, FIG. 5B a partly-cut-away side view and FIG. 5C a side view. The adjusting member 36 is made of a dielectric material or metal and designed to be adjustable in position by means of a screw 35. This embodiment permits fine control of the coupling between the resonators, and hence it is suitable for adjustment of the filter characteristic.

Figure 6:
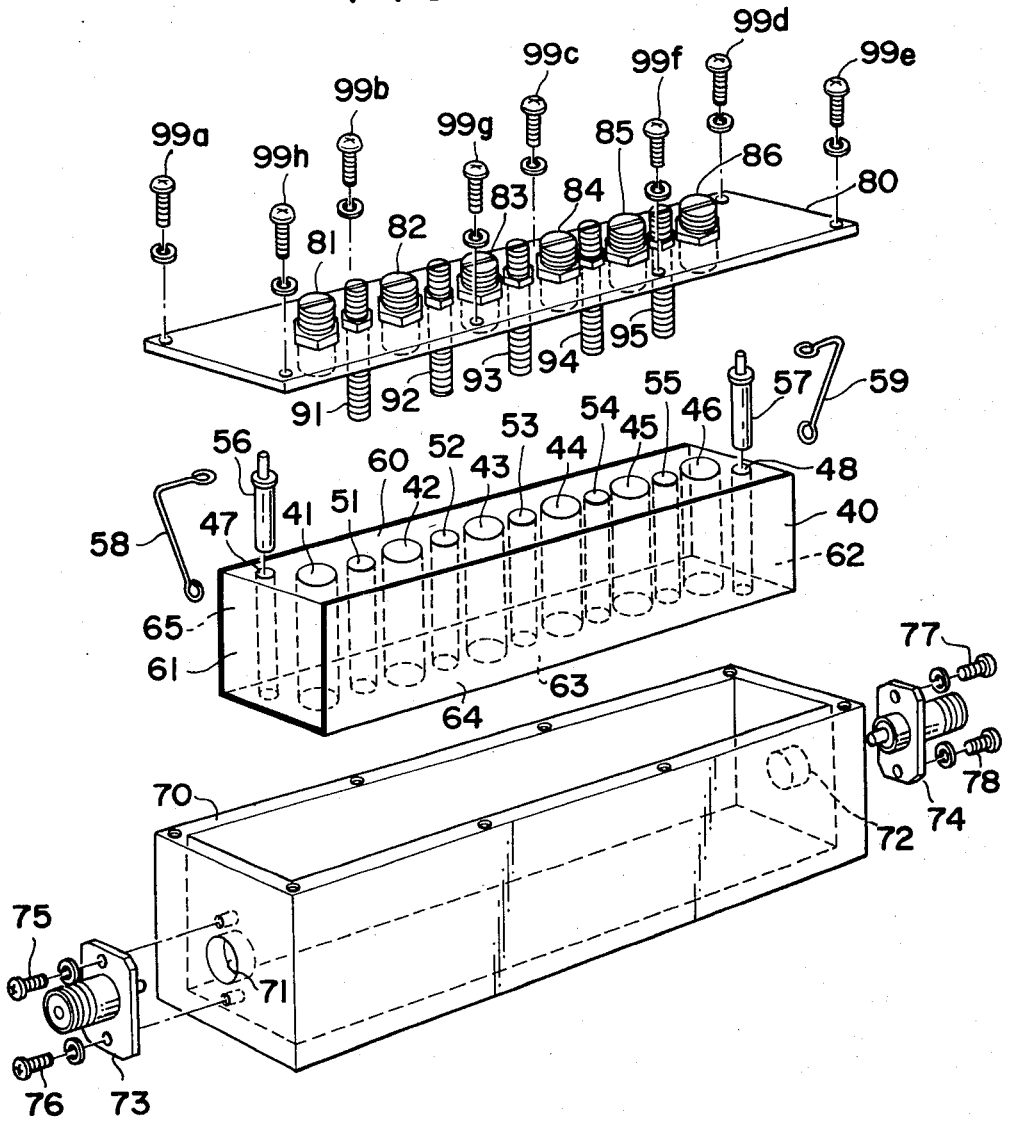
FIG. 6 is an exploded perspective view showing a six-section dielectric filter embodying the present invention.

FIG. 6 is an exploded perspective view showing a specific arrangement of an embodiment of the present invention. A dielectric block 40 is made of, for example, a Ti-Ba ceramic having a high dielectric constant $\epsilon_r$ of about 38. The dielectric block 40 has made therein holes 41 to 46 for constituting resonators, holes 47 and 48 for input/output coupling use and holes 51 to 55 for adjusting the coupling between adjacent ones of the resonators. The underside 63 and opposite sides 64 and 65 of the dielectric block 40 and the interior surfaces of the holes 41 to 46 are covered, for example, with a Ag-Pt thick film conductor. The thickness of this film is about 15 μm. The dielectric material is exposed on the top surface 60, both end faces 61 and 62 of the dielectric block 40, and the interior surfaces of the holes 47, 48 and 51 to 55. Consequently, the thick film conductor deposited on the interior surface of each of the holes 41 to 46 serves as an inner conductor of each resonator and the thick film conductor on the underside 63 and the both side faces 64 and 65 of the dielectric block 40 serves as an outer conductor of the resonator. In other words, six $\frac{1}{4}$ wavelength resonators are provided in which the top surface 60 of the dielectric block 40 is an open plane and the underside 63 is a short-circuit plane. Metal rods 56 and 57 are respectively inserted into the holes 47 and 48 to form input and output terminals utilizing electrical coupling.

Since the dielectric constant $\epsilon_r$ of the dielectric block 40 is large, resonant electromagnetic field energy is mostly confined in the dielectric block 40, and the aforesaid structure can be employed as a dielectric filter.

Yet, since the top surface 60 of the dielectric block 40 is an open plane on which no thick film conductor is deposited a very small quantity of electromagnetic field energy is emitted. Therefore, the dielectric block 40 is housed in a metal case 70 and hermetically sealed by a lid of metal 80. Of course, the case 70 may be one that is produced by machining, plate working or the like with dimensional tolerances. In both end portions of the metal case 70 there are made holes 71 and 72 for receiving terminals of connectors 73 and 74, respectively. The connectors 73 and 74 are fixed to the metal case 70 by means of screws 75 to 78.

The metal case 70 and the thick film conductor on the underside 63 of the dielectric block 40 are electrically and mechanically fixed together as by soldering. The metal rods 56 and 57 and the terminals of the connectors 73 and 74 are interconnected by conductor wires 58 and 59.

The metal plate 80 has mounted thereon screws 81 to 86, for fine controlling resonance frequency of the holes 41 to 46 of the dielectric block 40, and coupling adjustment screws 91 to 95 which are inserted into the holes 51 to 55 of the dielectric block 40. The metal plate 80 is fixed by screws 99*a* to 99*h* to the metal case 70. With such an arrangement , the equivalent lengths of the inner conductors of the resonators vary with the distances between the screws 81 to 86 and the holes 41 to 46; thus, the resonance frequencies of the resonators can be fine-controlled. Further, coupling between adjacent ones of the resonators is adjusted in accordance with the distance that the screws 91 to 95 are inserted into the holes 51 to 55. The dielectric block 40 is completely surrounded by the metal case 70 and the metal plate 80, providing a filter of stable operation.

Figure 7:
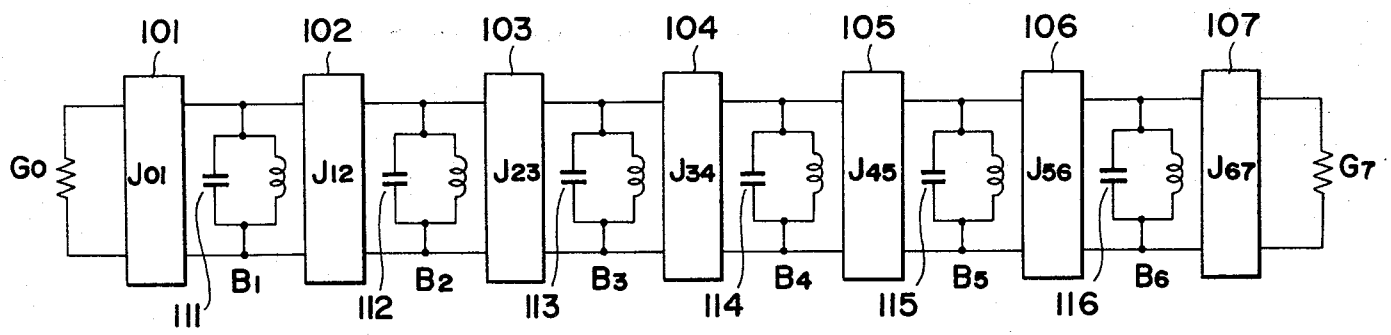
FIG. 7 shows an equivalent circuit of the dielectric filter depicted in FIG. 6.

FIG. 7 illustrates an equivalent circuit of the dielectric filter of the arrangement shown in FIG. 6. Reference characters $B_1$ to $B_6$ indicate susceptances of the respective resonators and, in the vicinity of the working frequency, each of them can be regarded as an L-C parallel resonance circuit, as shown. $J_{01}$ to $J_{67}$ designate parameters of admittance inverters 101 to 107 which convert the parallel resonance circuits to series resonance circuits and, at the same, change external loaded Q of the respective resonators, too. The parameters $J_{01}$ to $J_{67}$ are set to desired values by selecting the coupling strengths between the holes 47 and 41, between 41 and 42, between 42 and 43, between 43 and 44, between 44 and 45, between 45 and 46 and between 46 and 48, achieving the required characteristics of the filter. The screws 91 to 95 in FIG. 6 are provided for fine control of the parameters $J_{01}$ to $J_{67}$. The screws 81 to 86 are to alter fringing capacitances between the end faces of the holes 41 to 46 and the tips of the screws, thereby changing capacitances 111 to 116 of the susceptances $B_1$ to $B_6$ to perform fine control of the resonance frequencies. Reference characters $G_0$ and $G_7$ identify input and output loads.

Figure 8:
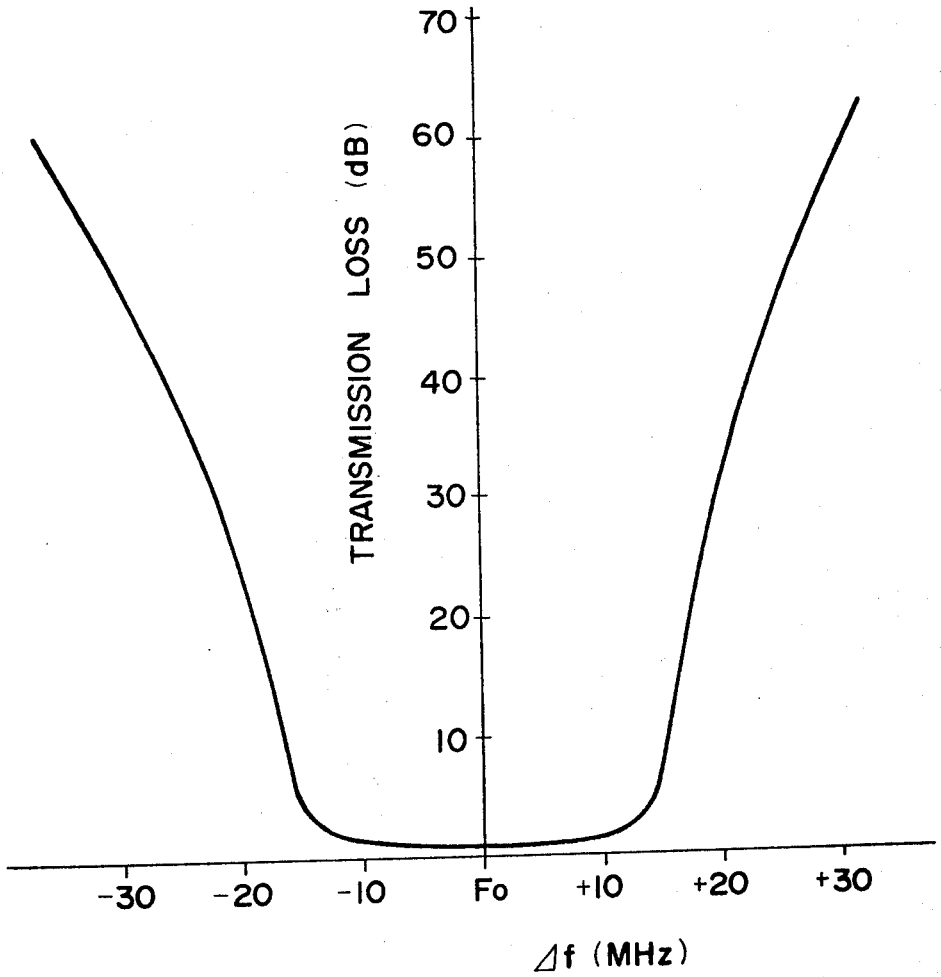
FIG. 8 is a graph showing the characteristics of the dielectric filter depicted in FIG. 6.

FIG. 8 shows the transmission characteristic of a Tchbyscheff filter with the six sections of the above-described embodiment, with a resonance frequency $F_0$ set to 876 MHz. The abscissa represents the frequency $\Delta f$, which is the difference from the center frequency $F_0$, and the ordinate represents the transmission loss. The transmission characteristic shown is one that was obtained in the case where the dielectric block 40 had a length of about 80 millimeters and a rectangular cross-section measuring 13.5 millimeters by 13.5 millimeters, the holes 41 to 46 and 51 to 55 were 4 millimeters in diameter and the holes 47 and 48 were 2.5 millimeters in diameter. The transmission loss was 1.2 dB when the center frequency $F_0$ was 876 MHz. VSWR $\leqq 1.2$ and the band width used was 24 MHz.

As has been described in the foregoing, according to the present invention, a plurality of holes is made in a dielectric block at predetermined intervals and the surface of the dielectric block, including the interior surfaces of the holes, is covered with a conductor film as by metalization to constitute resonators whose resonance frequencies depend on the depths of the individual holes. Since the resonators are formed as a unitary structure by the dielectric block, the dielectric filter of the present invention is excellent in the resistance to vibration and shock. Further, since the sizes of holes and their spacings can easily be held within allowed limits of tolerances, the dielectric filter can be mass-produced with ease. In addition, the manufacture of the dielectric filter of the present invention is free from the steps of positioning and fixing resonators which are involved when using simple resonators, and the number of parts used is small; therefore, the dielectric filter can be produced at low cost. Moreover, the conductor film on the surface of the dielectric block serves as an electrical shield, so that the filter need not always be housed in a metal case or, if necessary, it may be housed in a simple metal case, and consequently the dielectric filter can be made lightweight. Accordingly, the present invention provides a dielectric filter which is small, lightweight, stable mechanically and electrically, and inexpensive.

Furthermore, by forming an air gap between adjacent resonators and selecting the size of the gap or inserting an adjusting member of a dielectric or metallic material into the gap to a selected depth, coupling between the resonators and their resonance frequencies can be altered, so that the filter characteristic can easily be adjusted.

It will be apparent that many modifications and variations may be effected without departing from the scope of the novel concepts of the present invention.

What is claimed is:

1. A dielectric filter comprising a dielectric block having a plurality of holes at predetermined intervals, and a conductor film over the surface of the dielectric block including the interior surfaces of the holes, constituting resonators having resonance frequencies based on the depths of the holes, wherein an air gap for adjusting at least one of the coupling between the resonators and their resonance frequencies is provided in the dielectric block between the holes constituting the resonators, and further comprising an adjusting member mounted for movement in and out of the air gap.

2. A dielectric filter according to claim 1 wherein the adjusting member is made of metal.

3. A dielectric filter according to claim 1 wherein the adjusting member is made of a dielectric material.

4. A dielectric filter comprising:

a dielectric block having an outer surface and at least one first cavity extending from said outer surface to provide at least one first internal surface;

connector means for introducing radio frequency energy into said block and for withdrawing radio frequency energy from said block; and a conductive film coating at least part of said outer surface of said block and at least part of said at least one first internal surface therein, wherein said dielectric block has a plurality of first cavities spaced apart from one another to provide a plurality of first inner surfaces, wherein said conductive film extends into each of said plurality of first cavities, and wherein said block has at least one second cavity extending from the outer surface thereof and positioned between two of said first cavities to provide at least one second internal surface, said conductive film not coating said at least one second internal surface.

5. The dielectric filter of claim 4, further comprising means communicating with said plurality of first cavities for adjusting the frequency and means communicating with said at least one second cavity for adjusting the coupling.

6. A dielectric filter, comprising:

a dielectric block having an outer surface and at least one first cavity extending from said outer surface to provide at least one first internal surface;

connector means for introducing radio frequency energy into said block and for withdrawing radio frequency energy from said block; and a conductive film coating at least part of said outer surface of said block and at least part of said at least one first internal surface therein, wherein said dielectric block has a plurality of first cavities spaced apart from one another to provide a plurality of first inner surfaces, wherein said conductive film extends into each of said plurality of first cavities, wherein said block is elongated and has a first end and a second end, wherein said first internal cavities are elongated and have axes substantially perpendicular to the axis of said block, wherein said connector means comprises a first connector adjacent the first end of the block and a second connector adjacent the second end of the block, each of the first cavities being positioned between the first and second connectors, and wherein said block has at least one second cavity extending from the outer surface thereof and positioned between two adjacent first cavities to provide at least one second internal surface, said conductive film not coating said at least one second internal surface, said at least one cavity being elongated and having an axis substantially perpendicular to the axis of said block.

7. The dielectric filter of claim 6, wherein the axes of each of said plurality of first cavities and said at least one second cavity are substantially parallel to one another.

8. The dielectric filter of claim 7, wherein each of said first cavities extends only partially through said block, said conductive film substantially entirely coating the internal surface provided by each first cavity.

9. The dielectric filter of claim 7, wherein each of said first cavities extends entirely through said block, said conductive film coating only a portion of the internal surface provided by each first cavity.

10. The dielectric filter of claim 7, wherein each of said first cavities extends entirely through said block, said conductive film substantially entirely coating the internal surface provided by each first cavity.

11. The dielectric filter of claim 8, 9 or 10, wherein the first and second cavities are cylindrical and further comprising means communicating with said at least one second cavity for adjusting the coupling.

12. The dielectric filter of claim 11, wherein said means communicating with said at least one second cavity comprises a support mounted on the block and a screw movably extending through said support into said at least one second cavity.

13. The dielectric filter of claim 11, further comprising means communicating with said plurality of first cavities for adjusting the frequency.

14. The dielectric filter of claim 13, wherein said means communicating with said plurality of first cavities comprises a plurality of first screws movably mounted to extend into said first cavities, and wherein said means communicating with said at least one second cavity comprises at least one second screw movably mounted to extend into said at least one second cavity.

15. A dielectric filter, comprising:

a dielectric block having an outer surface and at least one first cavity extending from said outer surface to provide at least one first internal surface;

connector means for introducing radio frequency energy into said block and for withdrawing radio frequency energy from said block; and a conductive film coating at least part of said outer surface of said block and at least part of said at least one first internal surface therein, wherein said dielectric block has a plurality of first cavities spaced apart from one another to provide a plurality of first inner surfaces, wherein said conductive film extends into each of said plurality of first cavities, wherein said dielectric block comprises a substantially brick-shaped elongated element having first and second ends with an axis through the first and second ends and having first and second sides extending between the first and second ends, wherein said plurality of first cavities are cylindrical cavities extending from said first side of said block, the axes of said first cavities being substantially parallel to one another and substantially perpendicular to the axis of said block, wherein said conductive film comprises a metalized layer coating at least part of each first cavity and the first side of the block, wherein said metalized layer coats substantially entirely the internal surface provided by each first cavity, and wherein said block additionally has at least one cylindrical second cavity extending from the second side of said block and positioned between two adjacent first cavities, said at least one second cavity having an axis substantially parallel to the axes of said plurality of first cavities, and further comprising at least one elongated second element, and means mounted on the second side of said block for adjustably supporting said at least one second element so that each at least one second element has at least a portion thereof within a corresponding at least one second cavity.

* * * * *

UNITED STATES PATENT AND TRADEMARK OFFICE

CERTIFICATE OF CORRECTION

PATENT NO. : 4,410,868

DATED : October 18, 1983

INVENTOR(S) : Meguro et al.

It is certified that error appears in the above-identified patent and that said Letters Patent is hereby corrected as shown below:

Col. 2, line 29, delete "and";
line 32, after "tors" insert --,--;
line 43, "Further" should be --Furthermore--;
line 57, after "be" insert --a--.

Col. 3, line 44, "gas" should be --gap--.

Col. 4, line 26, after "deposited" inset --,--;
line 43, "controlling" should be --control of the--;
line 48, "arrangement ," should be --arrangement,--

Col. 6, line 9, after "1" insert --,--;
line 11, after "1" insert --,--.

Signed and Sealed this

Seventeenth Day of January 1984

[SEAL]

*Attest:*

GERALD J. MOSSINGHOFF

*Attesting Officer*

*Commissioner of Patents and Trademarks*